US009725971B2

(12) United States Patent
Yajure et al.

(10) Patent No.: US 9,725,971 B2
(45) Date of Patent: Aug. 8, 2017

(54) SYSTEM AND METHOD FOR CONTINUOUS CIRCULATION

(71) Applicant: Tesco Corporation, Houston, TX (US)

(72) Inventors: Edgar Fernando Yajure, Calgary (CA); Ryan Thomas Bowley, Calgary (CA)

(73) Assignee: TESCO CORPORATION, Houston, TX (US)

( * ) Notice: Subject to any disclaimer, the term of this patent is extended or adjusted under 35 U.S.C. 154(b) by 548 days.

(21) Appl. No.: 14/255,814

(22) Filed: Apr. 17, 2014

(65) Prior Publication Data

US 2014/0224509 A1 Aug. 14, 2014

Related U.S. Application Data

(63) Continuation-in-part of application No. 13/655,798, filed on Oct. 19, 2012, now Pat. No. 9,359,835, and a continuation-in-part of application No. 13/339,161, filed on Dec. 28, 2011, now Pat. No. 9,175,524.

(51) Int. Cl.
*E21B 19/16* (2006.01)
*E21B 21/10* (2006.01)

(52) U.S. Cl.
CPC ..... *E21B 19/165* (2013.01); *E21B 21/106* (2013.01)

(58) Field of Classification Search
CPC ..... E21B 19/165; E21B 21/106; E21B 19/00; E21B 19/07; E21B 19/161; E21B 19/16
See application file for complete search history.

(56) References Cited

U.S. PATENT DOCUMENTS

| | | | | |
|---|---|---|---|---|
| 4,867,236 | A | 9/1989 | Haney et al. | |
| 5,036,927 | A | 8/1991 | Willis | |
| 5,441,310 | A | 8/1995 | Barrett et al. | |
| 6,311,792 | B1 | 11/2001 | Scott et al. | |
| 6,578,632 | B2 * | 6/2003 | Mullins | E21B 21/01 166/177.4 |

(Continued)

FOREIGN PATENT DOCUMENTS

| | | |
|---|---|---|
| EP | 0311455 | 4/1989 |
| GB | 2378199 | 2/2003 |

OTHER PUBLICATIONS

Warren Schneider, Casing Drive System Drives Safety, Efficiency, E&P, Jan. 1, 2007.
Tesco Casing Drive System, Tesco Corporation, 2011.

*Primary Examiner* — Daniel P Stephenson
(74) *Attorney, Agent, or Firm* — Fletcher Yoder, P.C.

(57) ABSTRACT

Present embodiments are directed to a circulation system including a circulation management system. A housing of a coupling feature of the circulation management system is configured to extend over a box end of a pipe element. A seal disposed within the housing is configured to engage with a face of the box end. A force-application feature is configured to force the seal against the face of the box end to establish a sealed engagement between the circulation management system and the pipe element. A flow path of the circulation management system extends through the housing and the seal, wherein the flow path facilitates fluid flow into the pipe element from the circulation management system when the sealed engagement is established. A port to the flow path is configured to couple with a fluid flow supply feature.

14 Claims, 6 Drawing Sheets

(56) References Cited

U.S. PATENT DOCUMENTS

| | | | |
|---|---|---|---|
| 6,679,333 | B2 | 1/2004 | York et al. |
| 7,191,840 | B2 | 3/2007 | Pietras et al. |
| 7,543,650 | B2 | 6/2009 | Richardson |
| 7,770,654 | B2 | 8/2010 | Beierbach et al. |
| 7,854,265 | B2 | 12/2010 | Zimmermann |
| 2004/0216924 | A1 | 11/2004 | Pietras et al. |
| 2004/0256871 | A1 | 12/2004 | Leman et al. |
| 2007/0193751 | A1 | 8/2007 | Pietras et al. |

* cited by examiner

SYSTEM AND METHOD FOR CONTINUOUS CIRCULATION

CROSS-REFERENCE TO RELATED APPLICATIONS

This application is a continuation-in-part of U.S. application Ser. No. 13/655,798 entitled "PIPE DRIVE SEALING SYSTEM AND METHOD," and also a continuation-in-part of U.S. application Ser. No. 13/339,161 entitled "PIPE DRIVE SEALING SYSTEM AND METHOD", filed Dec. 28, 2011, each of which is hereby incorporated by reference.

BACKGROUND

Present embodiments relate generally to the field of drilling and processing of wells. More particularly, present embodiments relate to continuous circulation systems and methods.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore. Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore. An initial drillpipe element may be positioned in the wellbore and held in place by gripping devices near the rig floor, such as slips. Subsequent drillpipe elements may then be coupled to the existing drillpipe elements in the wellbore to continue formation of the drill string. Once attached, the drillpipe element and remaining drill string may be held in place by an elevator and released from the gripping devices (e.g., slips) such that the drill string can be lowered into the wellbore. Once the drill string is in place, the gripping devices can be reengaged to hold the drill string such that the elevator can be released and the process of attaching drillpipe elements can be started again. Similar procedures may be utilized for removing drillpipe from the wellbore.

Various fluids (e.g., drilling fluid or mud) may be utilized in well-related operations. For example, drilling fluid is typically circulated through the wellbore during rotary drilling operations. This circulation functions to bring cuttings to the surface, cool and lubricate aspects of the drill string (e.g., the drill bit), hold back subsurface pressure, and so forth. It is desirable to provide improved fluid circulation systems and methods for drilling-related applications.

DRAWINGS

These and other features, aspects, and advantages of the present disclosure will become better understood when the following detailed description is read with reference to the accompanying drawings in which like characters represent like parts throughout the drawings, wherein.

Figure 7:
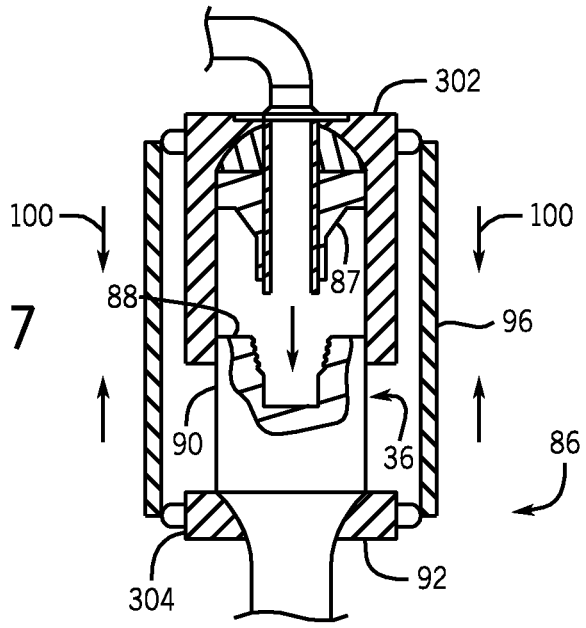
Figure 8:
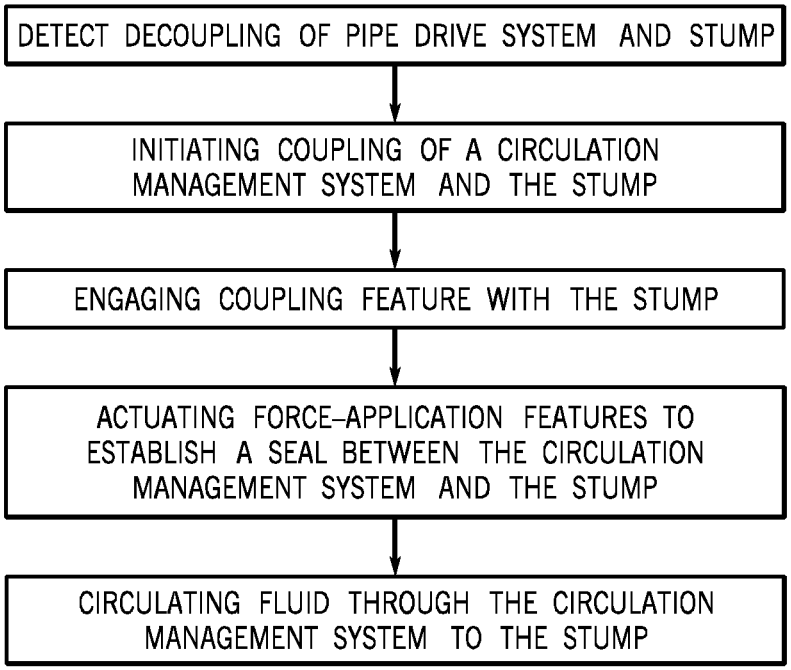

FIG. 7 a schematic cross-sectional side view of a continuous circulation management system including an upper portion and a lower portion that are configured to come together in engagement with and accommodate different box end geometries in accordance with present techniques; and FIG. 8 is a block diagram of a method in accordance with present techniques.

DETAILED DESCRIPTION

Present embodiments are directed to systems and methods for circulating fluids through well strings (e.g., a drilling string) such that interruptions in circulation through the respective well strings are limited during certain transition periods. More particularly, present embodiments relate to continuous circulation systems and methods that employ a coupler that facilitates rapid coupling of the continuous circulation system to a stump of a joint string through which it is desirable to circulate fluids.

In accordance with one embodiment, a continuous circulation management system includes a quick coupler that facilitates sealed engagement of a fluid circulation feature with a pipe stump (e.g., the stump of a drill string). Further, such a system may include features that facilitate directing the fluid to the circulation management system and circulation of the fluid through the pipe string associated with the pipe stump via the sealed engagement. For example, present embodiments include a fluid circulation management system with a coupling feature that enables rapid engagement of the fluid circulation management system with a stump of a drill string for maintaining circulation through the drill string during a process step in which a pipe drive system is decoupled from the stump, such as when the pipe drive system is decoupled for adding drillpipe stands or tripping drillpipe stands out of the hole.

A pipe drive system (e.g., a top drive), which may be broadly referred to as being incorporated with pipe handling equipment, may be used to facilitate assembly and disassembly of drill strings. Indeed, a pipe drive system may be employed to engage and lift a drillpipe element (e.g., a drillpipe joint), align the drillpipe element with a drill string, stab a pin end of the drillpipe element into a box end of the drill string, engage the drill string, and apply torque to make-up a coupling between the drillpipe element and the drill string. Thus, a pipe drive system may be employed to extend the drill string. Similarly, the pipe drive system may be used to disassemble drillpipe elements from a drill string by applying reverse torque and lifting the drillpipe elements out of the engagement with the remaining drill string. It should be noted that torque may be applied using a top drive system coupled to the pipe drive system or integral with the pipe drive system. Further, pipe handling equipment associated with or including the pipe drive system may provide fluid circulation through associated drillpipe while connected with the drillpipe.

Each drillpipe element typically includes a pin end and a box end to facilitate coupling of multiple joints of drillpipe. When positioning and assembling drillpipe elements in the wellbore, a drillpipe element is typically inserted into the wellbore until only an upper end is exposed above the wellbore. This exposed portion, which generally includes the box end, may be referred to as a stump. At this point, slips are typically positioned about the stump near the rig floor to hold the drillpipe element in place. The box end is typically positioned facing upward ("box up") such that the pin end of subsequently inserted drillpipe with the pin facing downward ("pin down") can be coupled with the box end of the previously inserted drillpipe or stump to continue formation of the downhole string. Drillpipe being added may be gripped at a distal end by a pipe drive system and the opposite distal end may be stabbed into the box end of the stump. Next, the pipe drive system may be employed to make-up a coupling between the drillpipe being added and the stump. Once the newly added drillpipe is appropriately attached, the gripping member may be removed and the drill string lowered further into the wellbore using an elevator. This process continues until a desired length of the drill string is achieved. Similarly, a reverse process may be used during removal of a drill string from a wellbore.

During a process of installing or removing drillpipe elements, it may be desirable to circulate fluids (e.g., drilling fluid or mud) through the associated drill string substantially continuously. However, during certain phases of a drilling process, the pipe drive system or pipe handling equipment, which may be a source of the fluid flow (e.g., drilling mud flow), must be decoupled from the drill string. For example, in order to engage with a drillpipe stand to be added or to complete extraction of a drillpipe stand from the hole, the pipe drive system is decoupled from communicative engagement with the drill string, which leaves the stump of the string open. This generally results in an inability to flow fluids from the pipe drive system or pipe handling equipment through the drill string during connection, disconnection, removal, or insertion phases of the process. Thus, present embodiments include systems and methods that facilitate rapid engagement of the open stump and circulation of fluids through the associated string during certain phases of the process. Indeed, present embodiments are directed to a circulation system that rapidly engages the stump, directs fluid (e.g., redirects fluid from the pipe handling equipment) through the circulation system into the string, and maintains circulation during phases of operation wherein the pipe handling equipment is decoupled from the stump.

Figure 1:
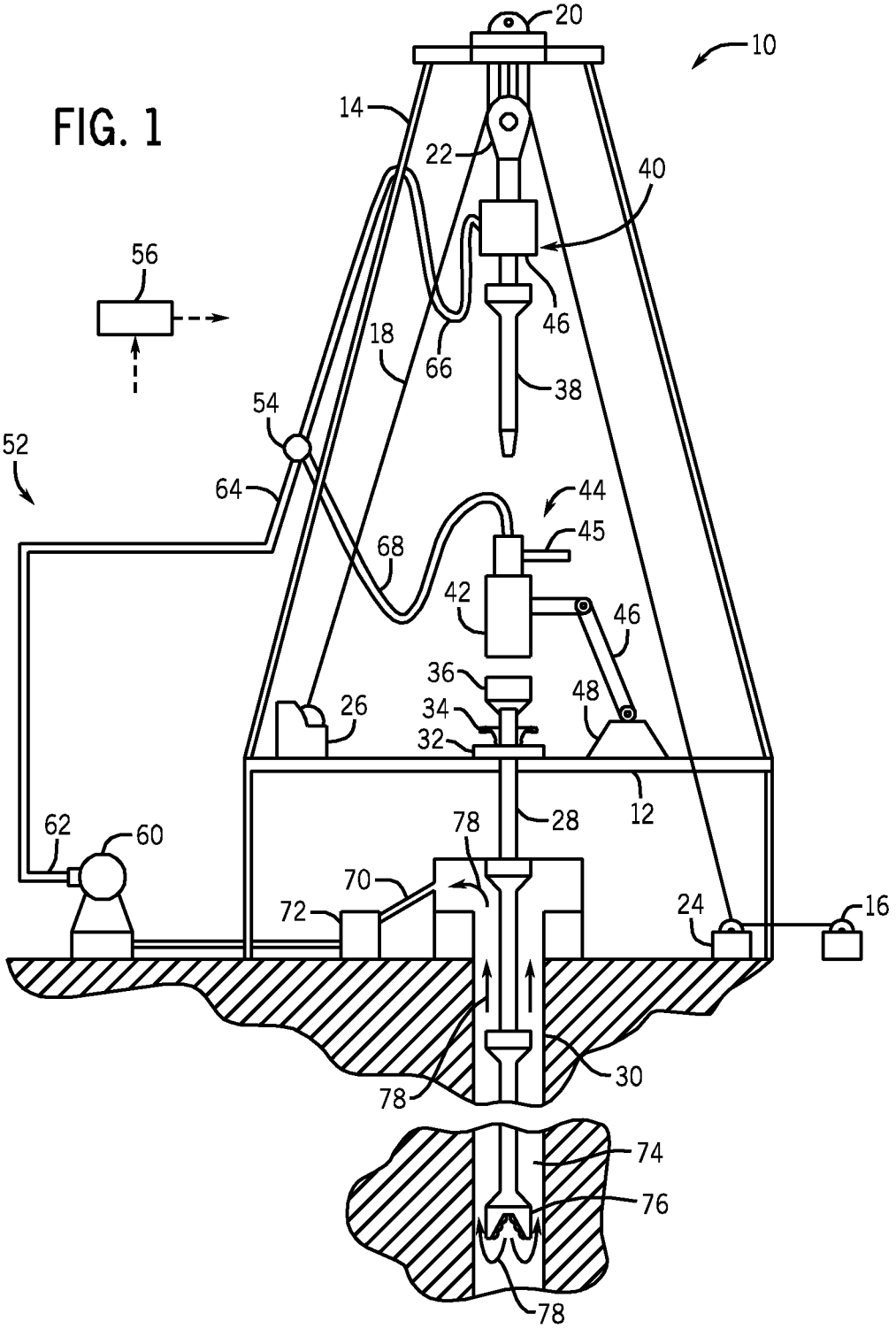
FIG. 1 is a schematic of a well being drilled in accordance with present techniques.

Turning now to the drawings, FIG. 1 is a schematic of a drilling rig 10 in the process of drilling a well in accordance with present techniques. While FIG. 1 represents a drilling process, present embodiments may be utilized for disassembly processes and so forth. In particular, present embodiments may be employed in procedures including assembly or disassembly of drillpipe elements, wherein it is desirable to provide an amount of fluid circulation through the drillpipe elements from a circulation system during operational phases in which a drillpipe handling system is decoupled from the stump (e.g., during assembly or disassembly procedures).

In the illustrated embodiment, the drilling rig 10 features an elevated rig floor 12 and a derrick 14 extending above the rig floor 12. A supply reel 16 supplies drilling line 18 to a crown block 20 and traveling block 22 configured to hoist various types of equipment and drillpipe above the rig floor 12. The drilling line 18 is secured to a deadline tiedown anchor 24. Further, a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drillpipe element or length of drillpipe 38 is in the process of being added.

The length of drillpipe 38 is held in place by a pipe drive system 40 that is hanging from the traveling block 22. In the illustrated embodiment, the pipe drive system 40 is holding the drillpipe 38 in alignment with the stump 36 for eventual coupling of the drillpipe 38 with the stump 36. Indeed, in the illustrated embodiment the pipe drive system 40 includes a top drive 46 (in some embodiments, the top drive 46 is separate from the pipe drive system 40) configured to supply torque for making-up and unmaking a coupling between the drillpipe 38 and the stump 36. However, in the illustrated instant of this phase of operation, the pipe drive system 40 remains out of communicative coupling with the stump 36 and thus out of communicative coupling with the drill string 28. Further, for various reasons, the process may be delayed such that the status of the operation is fixed in this decoupled orientation for an amount of time. Thus, present embodiments are directed to a system and method for facilitating maintenance of substantially continuous fluid circulation through the drill string 28 by facilitating rapid coupling of the stump 36 with a coupling device 42 of a circulation management system 44 in accordance with present embodiments. It may be beneficial to maintain circulation in this and similar situations (e.g., while changing drillpipe) to avoid issues that may result from a lack of circulation, such as cutting settling, downhole temperature excursions, stuck pipe incidents, and formation damage.

The coupling device 42 may facilitate communicative coupling (e.g., substantially sealed engagement that enables fluid flow through the engagement) between the circulation management system 44 and the drill string 28. Establishing this sealed passage facilitates circulation of fluid (e.g., drilling mud) through the circulation management system 44 into the drill string 28 via the stump 36 and maintenance of substantially continuous circulation while the pipe drive system 40 is decoupled from the drill string 28. Different embodiments of the coupling device 42 and circulation management system 44 may achieve such communicative coupling in different ways in accordance with present techniques. For example, in order to provide a reaction force with sufficient magnitude to counter pressure of the flowing fluid, the circulation management system 44 may hold the stump 36 (e.g., via a shoulder of the associated upset) with a set of fixed or moveable engagement or gripping features (e.g., elevator like protrusions) and pull the circulation management system 44 together with the stump 36. In other embodiments, the reaction force may be provided via a connection between the circulation management system 44 and the rig 10 or a semi-stationary base lifter (e.g., a cart with adjustable supports). For example, a sufficiently rigid mechanism attached to or integral with the circulation management system 44 may be coupled to the rig floor 12 and utilized to force the coupling device 42 against the stump 36 with sufficient force to establish a sealed engagement.

As generally indicated above, the coupling device 42 may include a seal that can be engaged with the stump 36 with sufficient force to establish a sealed engagement. The force utilized for such an engagement can be provided via various retention devices or techniques in accordance with present embodiments. For example, the stump 36 includes a box end with a shoulder and the coupling device 42 may include gripping features that engage the shoulder and pull the circulation management system 44 together with the stump 36 with sufficient axial force to establish sealed engagement (e.g., a face seal) between the two features, which facilitates fluid flow from the circulation management system 44 into the drill string 28 without substantial spillage. In such embodiments, the coupling device 42 may include gripping features, such as moveable dies, a fixed cradle, an articulated elevator, a pivoting clamp, a chain, or the like. In such embodiments, the coupling device 42 may attach to the stump 36 and apply an axial pulling force (e.g., via a hydraulic piston and cylinder) that pulls the circulation management system 44 over the stump 36 such that a seal within the circulation management system 44, or more specifically within the coupling device 42 of the circulation management system 44, engages with the stump 36 with sufficient force to establish a seal. In such embodiments, the circulation management system 44 may be suspended from the derrick 14 or otherwise non-rigidly attached to the rig 10. For example, the circulation management system 44 may be suspended from an arm 45, which may also include a port to be utilized as an access point to the string 28 via the circulation managing system 44 for a wireline or the like during circulation.

In other embodiments, the reaction force for establishing such sealed engagement may be provided via a rigid attachment of the circulation management system 44 to the rig 10. For example, in the illustrated embodiment, the circulation management system 44 is coupled to the rig floor 12 via a mechanical arm 46 and a base 48. In such an embodiment, the coupling device 42 may not include any features for gripping the stump 36, at least not via circumferential compression. Rather, the attachment (e.g., the attachment via the arm 46 and the base 48) of the circulation management system 44 to the rig 10 may be utilized to provide sufficient force between the coupling device 42 (e.g., a housing including a seal) and the stump 36 to establish a communicative engagement of the circulation management system 44 with the drill string 28.

The rig 10 also includes a general circulation system 52, which includes the circulation management system 44 and at least a fluid coupling point with the pipe drive system 40. During appropriate phases of operation, the general circulation system 52 directs fluid flow to the pipe drive system 40 or the circulation management system 44 via a valve 54 (e.g., a three-way valve) or the like. For example, when the pipe drive system 40 is communicatively coupled with the string 28, the valve 54 may direct fluid flow through the pipe drive system 40 and block flow to the circulation management system 44. However, when the pipe drive system 40 is decoupled from the string 28 to add pipe or the like, the valve 54 may direct flow to the circulation management system 44 to maintain circulation through the string 28 while the pipe drive system 40 is decoupled. In some embodiments, the general circulation system 52 may direct some fluid flow to both the pipe drive system 40 and the circulation management system 44, such as during transition periods. Further, the valve 54 (which may represent a system of valves) may be positioned to block all flow there through. The valve 54 and other aspects of the general circulation system 52, pipe drive system 40, circulation management system 44, and/or other aspects of the rig 10 may be automatically or manually controlled using an automation controller (e.g., programmable logic controller) and related control components generally represented by control system 56, which may include sensors, actuators, memory (non-transitory, computer-readable media), processors, and so forth.

In the illustrated embodiment, the general circulation system 52 includes fluid flow supply features such as a mud pump 60, a discharge line 62, a stand pipe 64, rotary hose 66 for the pipe drive system 40, a rotary hose 68 for the circulation management system 44, a return line 70, a retention tank 72, and other aspects of the rig 10. In operation, the mud pump 60 provides the motivating force for circulation of the drilling fluid. Specifically, the mud pump 60 pumps drilling fluid through the discharge line 62, the stand pipe 64, the rotary hoses 66, 68, the pipe drive system 40 and/or the circulation management system 44 based on an orientation of the valve 54. During circulation via the pipe drive system 40 or circulation management system 44, the drilling fluid flows through the drill string 28 and an associated bottom hole assembly (BHA) 74 to exit into the wellbore 30 via a drill bit 76. As indicated by arrows 78, the drilling fluid is then pushed up toward the surface through the annulus formed between the wellbore 30 and the drill string 28. As the drilling fluid proceeds up the annulus, it generally carries the rock cuttings and so forth with it to the surface. Once the drilling fluid reaches the surface, the return line 70 conveys the drilling fluid to the retention tank 72 (e.g., a series of multiple retention vessels), which feeds the mud pump 60. In some embodiments, a series of tanks and other components may be utilized to separate the cuttings from the drilling fluid before the drilling fluid is returned to the mud pump 60 to continue circulation.

Figure 2:
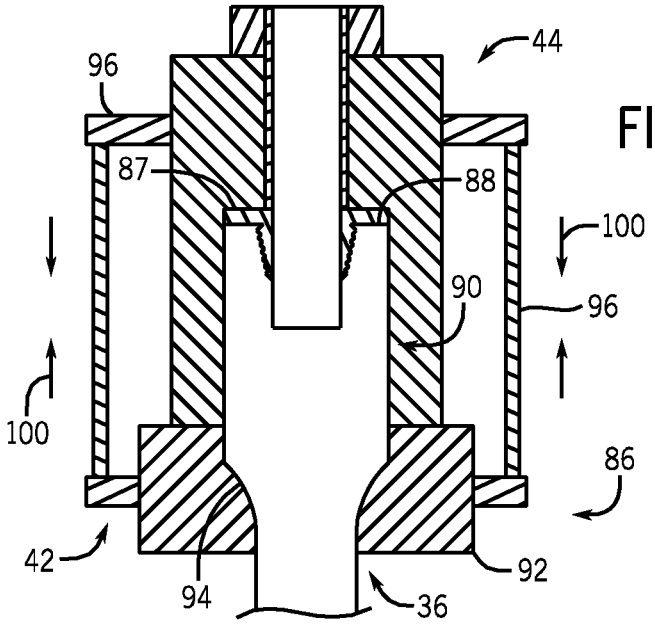
FIG. 2 is a schematic representation of a cross-sectional side view of a continuous circulation management system with a coupling feature attached to a pipe element in accordance with present techniques.

FIG. 2 is a schematic representation of an engagement between the circulation management system 44 and the stump 36 in accordance with present embodiments. This schematic of FIG. 2 broadly illustrates certain components of the circulation management system 44 including the coupling feature 42. The illustrated coupling feature 42 of FIG. 2 includes engagement features 86 that coordinate to apply pressure between a seal 87 of the circulation management system 44 and a face 88 of the stump 36, which includes a box end 90 of a tubular, to establish a properly sealed engagement that enables fluid flow from the circulation management system 44 into the stump 36. As an example, the seal 87 may be formed from nitrile rubber and may be designed to withstand pressures ranging from 1,000 psi to 6,000 psi to establish the properly sealed engagement.

Specifically, with reference to FIG. 2, the engagement features 86 include shoulder-coupling features 92 that are configured to engage a shoulder 94 of the box end 90. The shoulder-coupling features 92 may be representative of various such features including moveable dies, a fixed cradle, an articulated elevator, a pivoting clamp, a chain, a ball and detent feature, and so forth. Additionally, the engagement features 86 include force-application features 96, which are configured to apply a force or pressure between the circulation management system 44 and the stump 36, as indicated by arrows 100. The force-application features 96 may be representative of various such features, including hydraulic pistons and cylinders, chains and ratchets, tightening screws and receptacles, and so forth.

In one embodiment, the shoulder-coupling features 92 are configured to facilitate both lateral engagement with the stump 36 and to maintain sufficient axial force to provide the desired seal. For example, in one embodiment the shoulder-coupling features 92 include a ball and detent mechanism that includes a plurality of balls (or otherwise rounded features, such as rollers or round-ended cylinders) that are biased out of recesses disposed along an interior of a housing of the coupling feature 42. When the coupling feature 42 is pressed down over the box end 90 of the stump 36, the balls may be pressed into their respective recesses while passing over the outer walls of the box end 90 and then biased outward into engagement with the shoulder 94 when properly aligned therewith. Simply pulling the coupling feature 42 off of the stump 36 could break this engagement. However, the axial force applied while the balls are engaged with the shoulder 94 may be sufficient to maintain a seal during fluid flowing operations.

Figure 3:
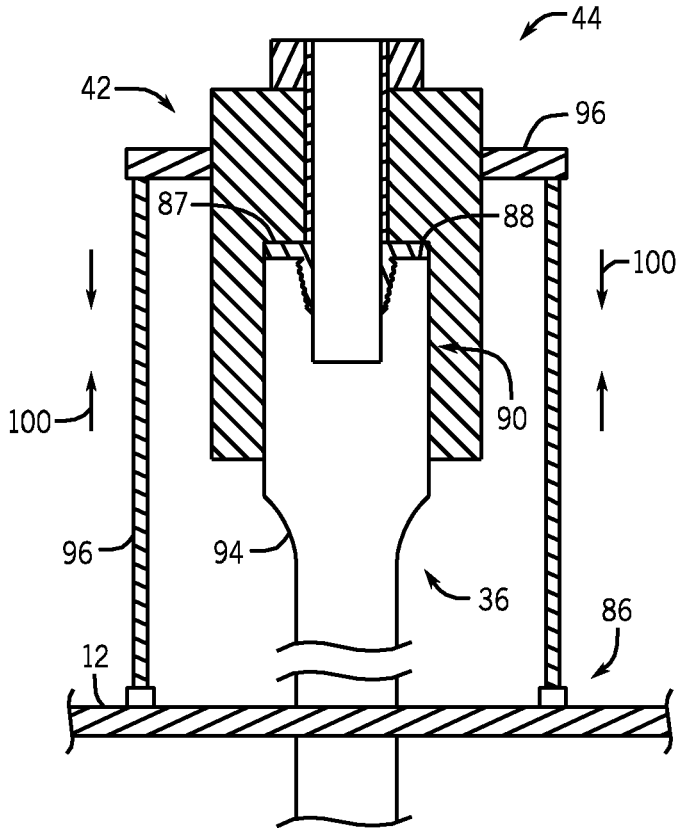
FIG. 3 is a schematic representation of a cross-sectional side view of a continuous circulation management system with a coupling feature attached to a drilling rig feature in accordance with present techniques.

In other embodiments, as illustrated in FIG. 3, the engagement features 86 do not directly engage with the stump 36 but rather apply pressure or force via a coupling with the rig 10. Specifically, in the illustrated embodiment of FIG. 3, the force (as represented by arrows 100) is applied by actuating the force-application features 96 while they are coupled to the rig floor 12 and with the coupling feature 42 of the circulation management system 44. In other embodiments, different features may be used, such as the arm 46 and base 48 of FIG. 1. In some embodiments, engagement features 86 may include force-application features 96 that utilize both engagement with the stump 36 and engagement with the rig 10 to apply the force 100 for establishing a seal between the circulation management system 44 and the stump 36. For example, present embodiments may include force-application features 96 that apply force via a coupling with the rig floor 12 and a separate engagement with the shoulder 94 at the same time.

Figure 4:
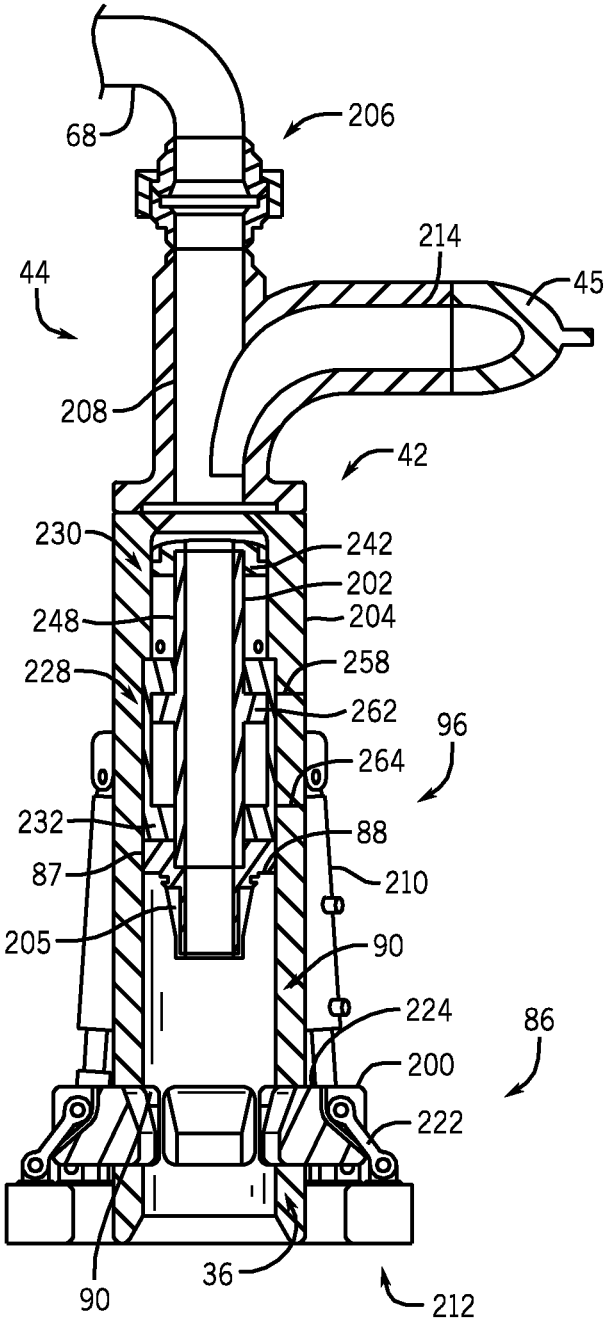
FIG. 4 is a cross-sectional side view of a continuous circulation management system in the process of coupling with a pipe element, wherein a coupling feature of the system is in a disengaged orientation in accordance with present techniques.
Figure 5:
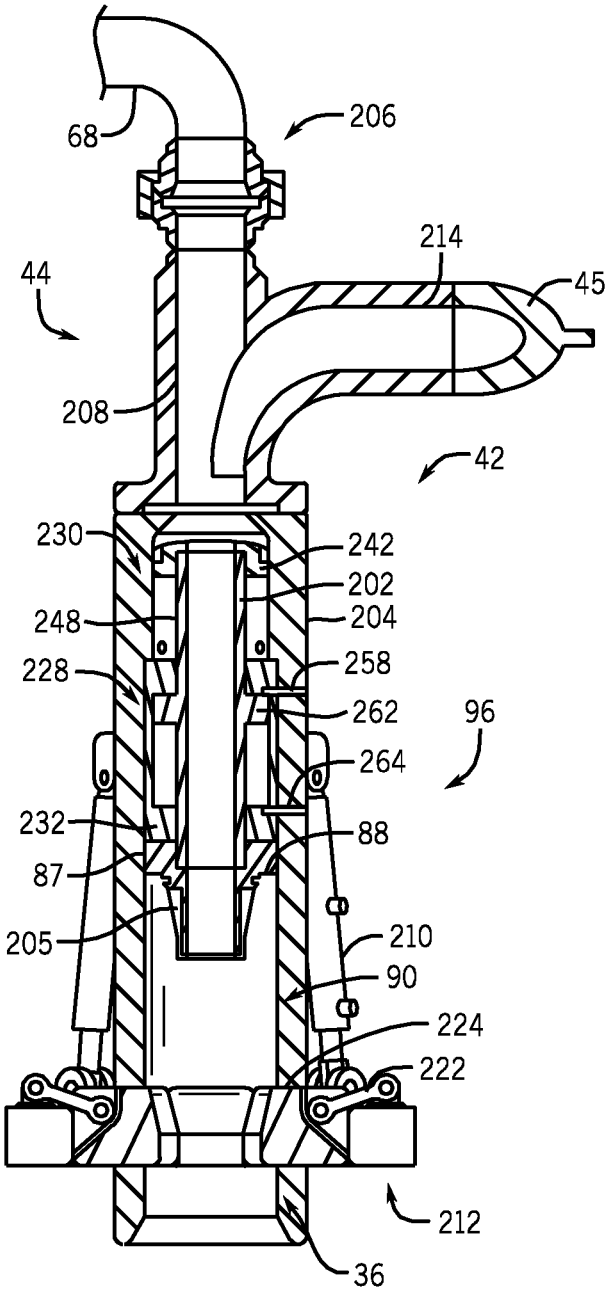
FIG. 5 is a cross-sectional side view of the continuous circulation management system of FIG. 4 coupled with the pipe element, wherein the coupling feature of the system is in an engaged orientation in accordance with present techniques.

FIGS. 4 and 5 include side cross-sectional views of a circulation management system 44 in the process of being coupled with the stump 36 in accordance with embodiments of the present techniques. In particular, FIGS. 4 and 5 represent the coupling feature 42 disposed over the stump 36 and the engagement features 86 moving from a disengaged orientation in FIG. 4 into an engaged orientation in FIG. 5. The coupling feature 42 includes elevators 200 and a seal piston 202 capable of being hydraulically energized to move within a housing 204 of the coupling feature 42 and to facilitate sealing engagement of the seal 87 against the stump 36, as will be discussed in detail below. As generally indicated above, the stump 36 includes a pipe joint. Thus, the stump 36 includes the box end 90, the face 88, the shoulder 94, threads 205, and other such features. It should be noted that, in other embodiments, different mechanisms are utilized. For example, the elevators 200 may be representative of any of various different coupling mechanisms.

In the embodiment illustrated by FIGS. 4 and 5, the circulation management system 44 includes various features that are at least partially visible from the outside of the circulation management system 44. Specifically, for example, the circulation management system 44 includes the main body or housing 204, a primary circulation coupling 206 configured to fluidly couple the general circulation system 52 to a main flow path 208 through the circulation management system 44, elevators 200, elevator actuators 210 (e.g., hydraulic pistons and rods that operate as the force-application features 96), an elevator support or lock 212, and a secondary entry 214 to the main flow path 208 (an access point through the arm 45). As will be discussed below, these features cooperate together to facilitate surrounding a portion of the stump 36, vertically securing the box end 90 within the coupling feature 42, creating a sealed engagement between the circulation management system 44 and the stump 36, and providing fluid circulation from the circulation management system 44 to the drill string 28 associated with the stump 36. The manner in which these features may function along with internal features and their operation will be discussed in detail below. It should be noted that the coupling feature 42 may include various aspects of the circulation management system, such as the housing 204 (or portions thereof), the engagement features 86, the force-application features 96, the seal 87, and related seal features (e.g., the seal piston 202).

Present embodiments are directed to establishing an engagement between the fluid circulation management system 44 and the stump 36 that can support a fluid seal that allows fluid circulation (e.g., drilling mud circulation) without substantial leakage. In particular, this involves applying sufficient force to establish such a sealed engagement between the seal 87 and aspects of the box end 90, such as the face 88 and threads 205. An initial aspect of establishing such an engagement, in the illustrated embodiment, includes engaging the shoulder 94 with the elevators 200 to support application of the desired axial force. In some embodiments, this includes positioning the box end 90 within the housing 204. For example, this may include maneuvering the circulation management system 44 into position over the stump 36 and lowering it such that the elevators 200 are aligned with the shoulder 94. This maneuvering may be achieved via various mechanisms attached to or integral with the circulation management system 44. For example, the circulation management system 44 may be suspended from a maneuverable arm (e.g., crane or robotic arm) coupled to the rig 10 (e.g., coupled via the arm 45) or positioned on a cart that can be rolled or otherwise maneuvered over the rig floor 12. In FIGS. 4 and 5, the circulation management system 44 is already positioned over the stump 36.

In the illustrated embodiments of FIGS. 4 and 5, the elevators 200 include links 222 and elevator blocks 224. The links 222 translate vertical motion into horizontal or radial motion and the elevator blocks 224 function to engage and secure the stump 36 within the circulation management system 44. Specifically, as the elevator support 212 moves up or down relative to the housing 204, the corresponding movement of the elevators 200 causes the links 222 to push or pull the elevator blocks 224 through openings in the housing 204 such that the elevator blocks 224 can engage or disengage with the shoulder 94. In FIG. 4, the elevators 200 are in a disengaged actuation state, while FIG. 5 illustrates the elevators 200 in an engaged actuation state. Specifically, as illustrated in FIG. 4, the elevator blocks 224 are generally retracted outside of the internal diameter of the housing 204. When the elevator blocks 224 are in this retracted position, the box end 90 can readily slide past the elevator blocks 224 into the housing 204. When the elevator blocks 224 are in the engaged position, as shown in FIG. 5, the elevator blocks 224 engage the shoulder 90 such that the elevator actuators 210 or some other force-application features 96 can be further actuated to generate the desired sealing force between the face 88 and/or threads 205 against the seal 87.

As noted above, when initially coupling the stump 36 and the coupling feature 42, the coupling feature 42 is first positioned over the stump 36 such that the elevator blocks 224 are generally aligned for engagement with the shoulder 94. Once this positioning is achieved, the elevator actuators 210 may actuate the elevators 200 to engage the elevator blocks 224 with the shoulder 94. To establish this alignment, the coupling feature 42 may include specified dimensions that achieve the proper orientation when the seal 87 engages the face 88. For example, to establish proper alignment of the elevator blocks 224 with the shoulder 94, the seal 87 may be arranged within the housing 204 based on standard tool joint sizes such that engagement of the face 88 of the box end 90 with the lowermost face of the seal 87 ensures that the shoulder 94 is properly positioned with respect to the elevator blocks 224 before actuation of the elevators 200. Once a desired positioning is achieved, the elevators 200 may be actuated to engage the stump 36 via the shoulder 94 and thus establish engagement for the application of the sealing force. As will be discussed below, the embodiments illustrated in FIGS. 4-6 include a sealing mechanism 228 that functions to accommodate different pipe geometries. For example, a piston assembly 230 of the sealing mechanism 228 is configured to move relative to the housing 204 and relative to a piston housing 232 in order to accommodate stumps with differently sized boxes. For example, the box 90 in FIG. 2 is longer than the box 90 in FIG. 3, yet the seal 87 is abutting the face 88 in a sealed engagement in both cases because the piston assembly 230 has been adjusted to accommodate the size of each box 90 in the respective embodiments.

Figure 6:
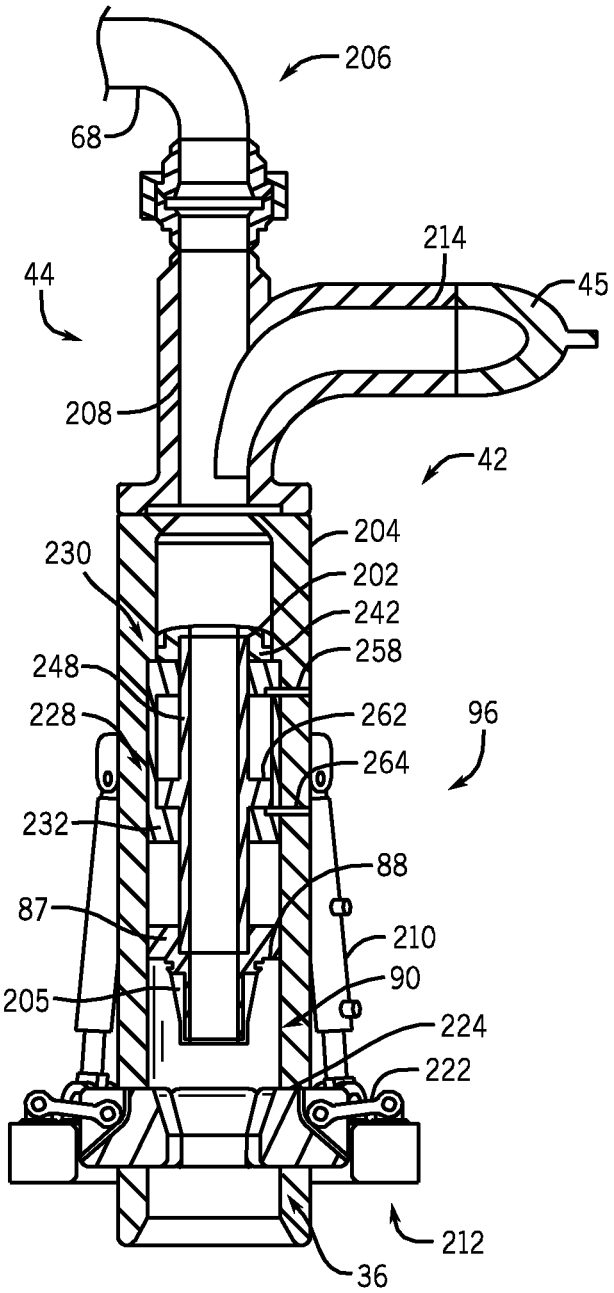
FIG. 6 is a cross-sectional side view of the continuous circulation management system of FIG. 4 coupled with a pipe element have a shortened box end, wherein the coupling feature of the system is in an engaged orientation in accordance with present techniques.

In the illustrated embodiment of FIGS. 5 and 6, the sealing mechanism 228 includes the seal piston 202, an upper seal 242 coupled to an upper portion of the seal piston 202, the lower seal 87 coupled with a lower portion of the seal piston 202, and the piston housing 232 that is coupled with the housing 204. The seal assembly 230 referenced above includes the seal piston 202, the upper seal 242, and the lower seal 87. In the illustrated embodiment, the seal piston 202 includes a hollow, double rod, double acting piston. The seal piston 202 generally includes an elongate hollow body 248 that extends through the piston housing 232. An upper end of the seal piston 202 extends through an upper opening in the piston housing 232 and a lower end of the seal piston 202 extends through a lower opening in the piston housing 232. Accordingly, the seal piston 202 can slide the lower seal 87 downward into engagement with the box end 90.

The seal piston 202 may be actuated by pressure. For example, an actuator may provide hydraulic pressure via an upper port 258 into the piston housing 232 such that pressure is increased on an upper side of a lip 262 of the seal piston 202 within the piston housing 232. This may force the seal piston 202 downward and correspondingly flush fluid out of a second, lower port 264 accessing the piston housing 232 that is below the lip 262. In turn, this actuation of the seal piston 202 may cause the lower seal 87 to move relative to the housing 204 and to engage the box end 90 (e.g., the face 88 and the threads 205) when the stump 36 is at least partially positioned within the coupling feature 42. Actuation of the seal piston 202 is observable by viewing the transition shown between FIGS. 5 and 6. The lip 262 of the seal piston 202 is positioned in the upper part of the piston housing 232 in FIG. 5 and in the lower part of the piston housing 232 in FIG. 6 (after being actuated to accommodate a shorter box end 90).

Pressure may also be applied to the seal piston 202 by fluid (e.g., drilling mud) passing through the main flow path 208 from the general circulation system 52. Specifically, for example, fluid coming from the general circulation system 52 may press on the upper seal 242 and force the piston assembly 230 in the flow direction. Pressure on the upper seal 242 may not be sufficient pressure to fully actuate the seal piston 202 in some embodiments. However, it may serve to preload the seal piston 202 for actuation by a separate actuator (e.g., a hydraulic actuator). Further, because the surface of the upper seal 242 exposed to pressure from fluid is larger than the surface of the lower seal 87 exposed to pressure from fluid, the seal piston 202 will generally be energized downward under fluid pressure (e.g., mud pressure). This may force the lower seal 87 against the box end 90 to prevent leakage in the event that an actuator for the seal piston 203, such as a hydraulic actuator, loses energy (e.g., pressure).

The upper seal 242 and the lower seal 87 may be integral with or attachable with the seal piston 202. Further, the upper seal 242 and the lower seal 87 may include numerous different seal features and combinations of seal features in accordance with present embodiments. The upper seal 242 illustrated in FIGS. 4-6 includes a main body that is coupled about an outer perimeter of the seal piston 202 and a hydraulic rod lip seal integrated with or installed in the main body. The lower seal 87 illustrated in FIGS. 4-6 includes a main body coupled about an outer perimeter of the seal piston 202 and a pair of O-rings integrated with or installed in the main body that are arranged to engage the face 88. The upper and lower seals 242, 87 may include any of various disclosed features in accordance with present embodiments. In some embodiments, one or more O-rings may be employed to create a labyrinth. Further, the O-rings may include commercially available O-rings and may be made of any of various different materials (e.g., rubber, metal, plastic, or nitrile).

In some embodiments, the sealing mechanism 228 may be simplified to not include the seal assembly 230 and yet be capable of accommodating box ends with varying dimensions. For example, as illustrated in FIG. 7, the coupling feature 42 may include an upper end 302 (e.g., housing 204) and a lower end 304 (e.g., engagement features 86) that coordinate to accommodate a range of box end sizes by actuating the force-application features 96 to varying degrees such that the upper end 302 and the lower end 304 are brought together to a sufficient degree (depending on the size of the box end) to force the seal 87 into engagement with the face 88. As illustrated in FIG. 7, the upper end 302 and lower end 304 are in the process of being engaged with the box end 90 and the seal 87 has not yet engaged the face 88.

FIG. 8 is a block diagram of a method 350 in accordance with present embodiments. The method 350 may begin with detecting (block 396) decoupling of a pipe drive system from a box end of a stump of a drill string and initiating (398) coupling of a circulation management system with the box end while the pipe drive system is decoupled from the box end. The method 350 includes engaging (block 402) a housing of a coupling feature of the circulation management system with the stump such that a box end of the stump is within the housing. Further, the method 350 includes actuating (block 404) force-application features to establish a sealed engagement between a seal positioned within the housing and a face of the box end. Additionally, the method 350 includes circulating (block 406) fluid from a fluid supply through a flow path of the circulation management system and into the stump.

While only certain features of present embodiments have been illustrated and described herein, many modifications and changes will occur to those skilled in the art. It is, therefore, to be understood that the appended claims are intended to cover all such modifications and changes as fall within the true spirit of the invention.

The invention claimed is:

1. A circulation system, comprising:

a circulation management system;

a coupling feature of the circulation management system;

a housing of the coupling feature configured to extend over a box end of a pipe element;

a seal disposed within the housing and configured to engage with a face of the box end;

a force-application feature configured to force the seal against the face of the box end to establish a sealed engagement between the circulation management system and the pipe element;

a flow path of the circulation management system, the flow path extending through the housing and the seal, wherein the flow path facilitates fluid flow into the pipe element from the circulation management system when the sealed engagement is established;

a port to the flow path, wherein the port is configured to couple with a fluid flow supply feature;

a piston assembly configured to coordinate with the force-application feature to establish the sealed engagement, wherein the piston assembly comprises a hollow piston with the seal disposed about the piston at an end of the piston opposite the port, and wherein the piston assembly is configured to move relative to the housing; and a piston housing and first and second ports into the piston housing, wherein a lip of the piston is disposed within the piston housing such that the seal and an additional seal are positioned on opposite sides of the lip, the first and second ports into the piston housing being on opposite sides of the lip to facilitate hydraulic actuation of the piston assembly.

2. The system of claim 1, wherein the force-application feature comprises elevators configured to engage a shoulder of the box end to establish support for forcing the seal against the face.

3. The system of claim 1, wherein the piston assembly is configured to be at least partially actuated by pressure from fluid flow against the additional seal disposed about the piston at an end of the piston proximate the port.

4. The system of claim 1, wherein the circulation management system comprises a mechanical arm and base configured to maneuver the housing over the box end.

5. The system of claim 1, comprising a valve configured to direct fluid flow from a general fluid circulation system to the port or from the general fluid circulation system to a pipe management system.

6. The system of claim 1, comprising a secondary passage into the flow path.

7. The system of claim 6, wherein the secondary passage comprises a wireline port configured to receive a wireline during operation of the circulation management system.

8. A circulation system, comprising:

a circulation management system;

a coupling feature of the circulation management system;

a housing of the coupling feature configured to extend over a box end of a pipe element;

a seal disposed within the housing and configured to engage with a face of the box end;

a force-application feature configured to force the seal against the face of the box end to establish a sealed engagement between the circulation management system and the pipe element;

a flow path of the circulation management system, the flow path extending through the housing and the seal, wherein the flow path facilitates fluid flow into the pipe element from the circulation management system when the sealed engagement is established;

a port to the flow path, wherein the port is configured to couple with a fluid flow supply feature; and a secondary passage into the flow path, wherein the secondary passage comprises a wireline port configured to receive a wireline during operation of the circulation management system.

9. The system of claim 8, wherein the force-application feature comprises elevators configured to engage a shoulder of the box end to establish support for forcing the seal against the face.

10. The system of claim 8, comprising a piston assembly configured to coordinate with the force-application feature to establish the sealed engagement, wherein the piston assembly comprises a hollow piston with the seal disposed about the piston at an end of the piston opposite the port, and wherein the piston assembly is configured to move relative to the housing.

11. The system of claim 10, wherein the piston assembly is configured to be at least partially actuated by pressure from fluid flow against an additional seal disposed about the piston at an end of the piston proximate the port.

12. The system of claim 10, comprising a piston housing and first and second ports into the piston housing, wherein a lip of the piston is disposed within the piston housing such that the seal and an additional seal are positioned on opposite sides of the lip, the first and second ports into the piston housing being on opposite sides of the lip to facilitate hydraulic actuation of the piston assembly.

13. The system of claim 8, wherein the circulation management system comprises a mechanical arm and base configured to maneuver the housing over the box end.

14. The system of claim 8, comprising a valve configured to direct fluid flow from a general fluid circulation system to the port or from the general fluid circulation system to a pipe management system.

* * * * *